US006817887B2

(12) United States Patent
Jones et al.

(10) Patent No.: US 6,817,887 B2
(45) Date of Patent: Nov. 16, 2004

(54) INSULATION DISPLACEMENT CONNECTION CONNECTOR HAVING IMPROVED LATCH MEMBER

(75) Inventors: Dennis B. Jones, Orange City, CA (US); George Lee, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/331,082

(22) Filed: Dec. 24, 2002

(65) Prior Publication Data

US 2004/0121642 A1 Jun. 24, 2004

(51) Int. Cl.[7] ..... H01R 4/24
(52) U.S. Cl. ..... 439/405
(58) Field of Search ..... 439/404, 405, 439/459, 497, 350

(56) References Cited

U.S. PATENT DOCUMENTS 4,621,885 A 11/1986 Szczesny et al.
4,693,533 A 9/1987 Szczesny et al.
5,125,850 A * 6/1992 Locati ..... 439/404
5,980,303 A * 11/1999 Lee et al. ..... 439/405
6,036,531 A * 3/2000 Lee et al. ..... 439/459
6,120,319 A * 9/2000 Lee et al. ..... 439/497
6,203,359 B1 * 3/2001 Lee ..... 439/405
6,398,581 B1 * 6/2002 Baier et al. ..... 439/404
6,533,607 B2 * 3/2003 Jochen et al. ..... 439/497

* cited by examiner

*Primary Examiner*—Thanh-Tam Le
(74) *Attorney, Agent, or Firm*—Wei Te Chung

(57) ABSTRACT

An IDC connector (2) is adapted for connecting a flat cable (5) to a header connector (3) and includes a bottom body (21) with a number of terminals (22) retained therein, a top cover (20) assembled to the bottom body and a latch member (4). The top cover has a scalloped bottom face (203) for terminating the flat cable. The header connector forms a girder (305) at each lateral end thereof. The latch member includes a first latch arm (41) for engaging with the girder and a second latch arm (42) for engaging with the bottom body. The first latch arm forms a push bottom (411) for handling and engaging with the bottom body for preventing the latch member from overstress.

3 Claims, 6 Drawing Sheets

INSULATION DISPLACEMENT CONNECTION CONNECTOR HAVING IMPROVED LATCH MEMBER

CROSS-REFERENCE TO RELATED APPLICATIONS

This patent application is related to a Co-pending Application of patent application Ser. No. 10/283,945, entitled "Insulation Displacement Connection Connector Having Improved Connection Features between Cover and Body thereof", filed on Oct. 29, 2002, invented by the same inventors and assigned to the same assignee as this patent application.

BACKGROUND OF THE INVENTION

1. Field of the Invention

The present invention relates to an Insulation Displacement Connection (IDC) connector, and particularly to an IDC connector having improved connection structure between a cover and a body of the IDC connector and between the IDC connector and a complementary header connector mounted on a Printed Circuit Board (PCB).

2. Description of Related Art

To connect a flat cable to a PCB, an IDC connector is usually used to terminate the flat cable. A header connector is mounted on the PCB. Then, the IDC connector mates with the header connector so that the flat cable is electrically connected with the PCB.

U.S. Pat. No. 5,893,773 disclosed an IDC connector which has protuberances on sidewalls of a body of the IDC connector so that a cover of the IDC connector can be positioned at an initial position before being pushed to a final position. At the initial position, a flat cable is movable on a terminating face of the body of the IDC connector. At the final position, the cable is compressed between the cover and the body and pierced by terminals of the IDC connector so that conductors in the cable electrically engage with the terminals.

For such a conventional IDC connector, there is no structure on the body of the IDC connector, which can securely fasten the connector to a header connector mounted on a PCB, so that a reliable electrical connection between the flat cable and the PCB is not reliable enough.

U.S. Pat. Nos. 4,693,533 and 4,621,885 disclosed an IDC connector engaging with a header connector. The IDC connector includes a bottom body, a top cover assembled to the bottom body and a latch member. The bottom body forms a detent at each lateral end thereof. The top cover forms a beam at each lateral end thereof. The latch member is U-shaped, having first and second latch arms and a formed bight therebetween for engaging with the beam of the top cover. The first arm has an aperture cooperating with the detent of the bottom body and secured the top cover to the bottom body whereby the top cover securely retaining a flat cable on the bottom body. The second latch arm at its distal end is formed with an outward hook. The header connector includes a housing with a pair of girders at opposite ends thereof for engaging with the hook thereby securing a true connection between the IDC connector and the header connector. However, since there is no protection structure for preventing the latch member from overstress, while the hooks are to release from the engaging with the girders, the latch member may be pressed unduly and become broken.

Therefore, it is necessary to provide an improved IDC connector assembly which can overcome the disadvantages of the prior art.

SUMMARY OF THE INVENTION

Accordingly, an object of the present invention is to provide an IDC connector in which a latch member for securely connecting the IDC connector to a header connector is protected from overstress.

To achieve the above object, an IDC connector for electrically connecting a flat cable to a complementary header connector, includes a bottom body, a plurality of terminals assembled to the bottom body adapted for electrically connecting with the flat cable and a latch member adapted for connecting the electrical connector to the header connector. The bottom body has a tower at a lateral end thereof. The latch member includes a first latch arm, a second latch arm and a bight therebetween. The latch member is assembled to the tower with a bottom surface of the bight abutting against with a top surface of the tower. The first latch arm forms a push bottom for handling and engaging with the tower to prevent the latch member from overstress.

Other objects, advantages and novel features of the invention will become more apparent from the following detailed description when taken in conjunction with the accompanying drawings.

DETAILED DESCRIPTION OF THE INVENTION

Figure 1:
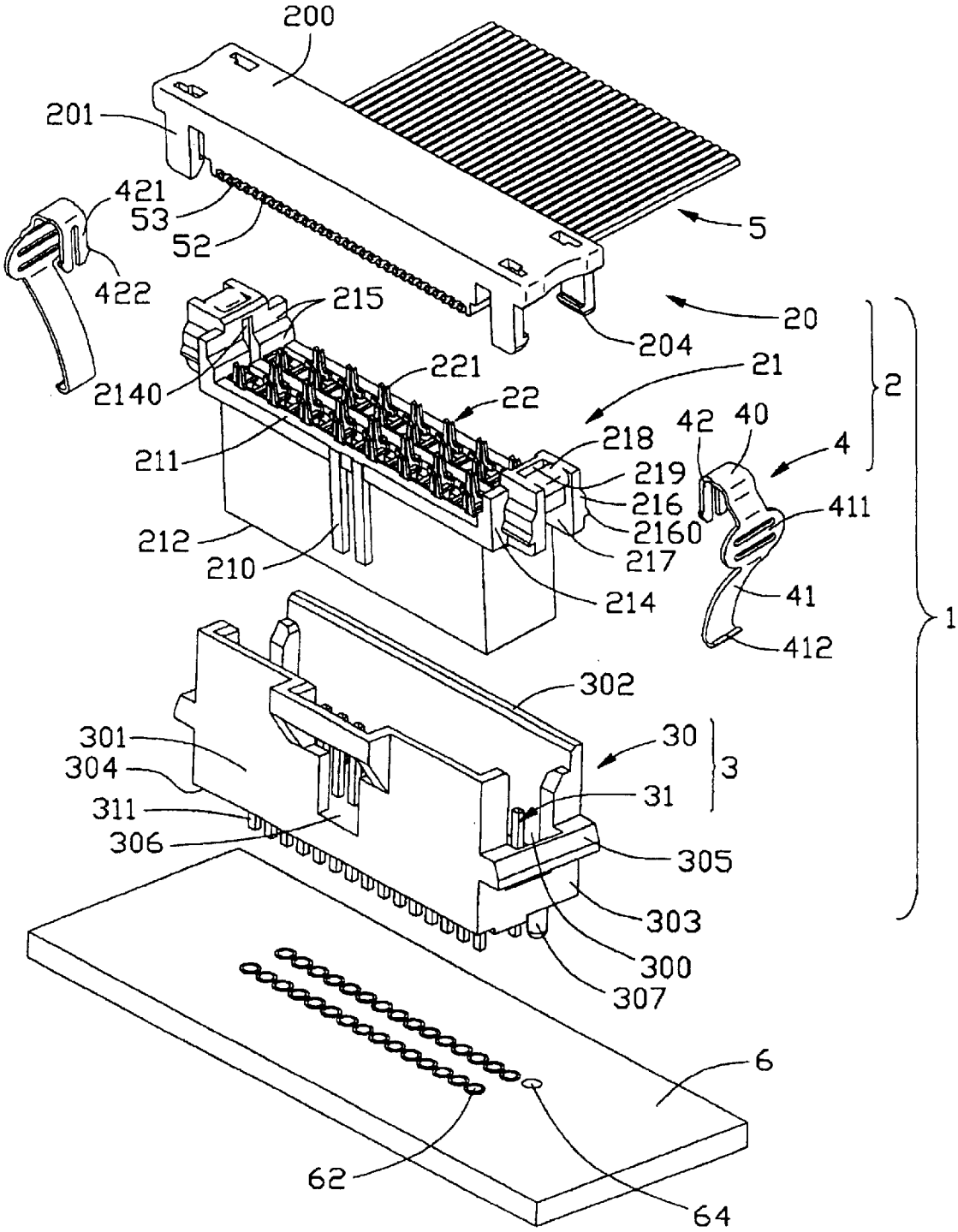
FIG. 1 is a perspective exploded view of an IDC connector in accordance with the present invention, with a flat cable, a header connector and a PCB.

Reference will now be made to the drawing figures to describe the present invention in detail.

Figure 2:
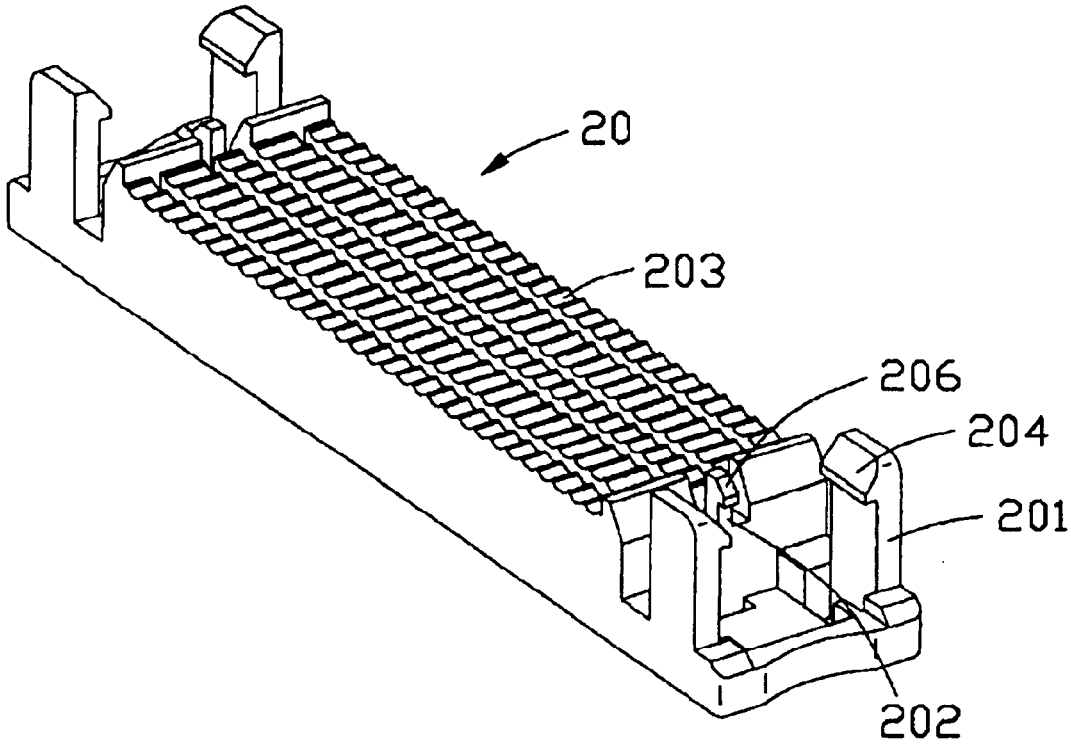
FIG. 2 is a bottom, perspective view showing a cover of the IDC connector.
Figure 3:
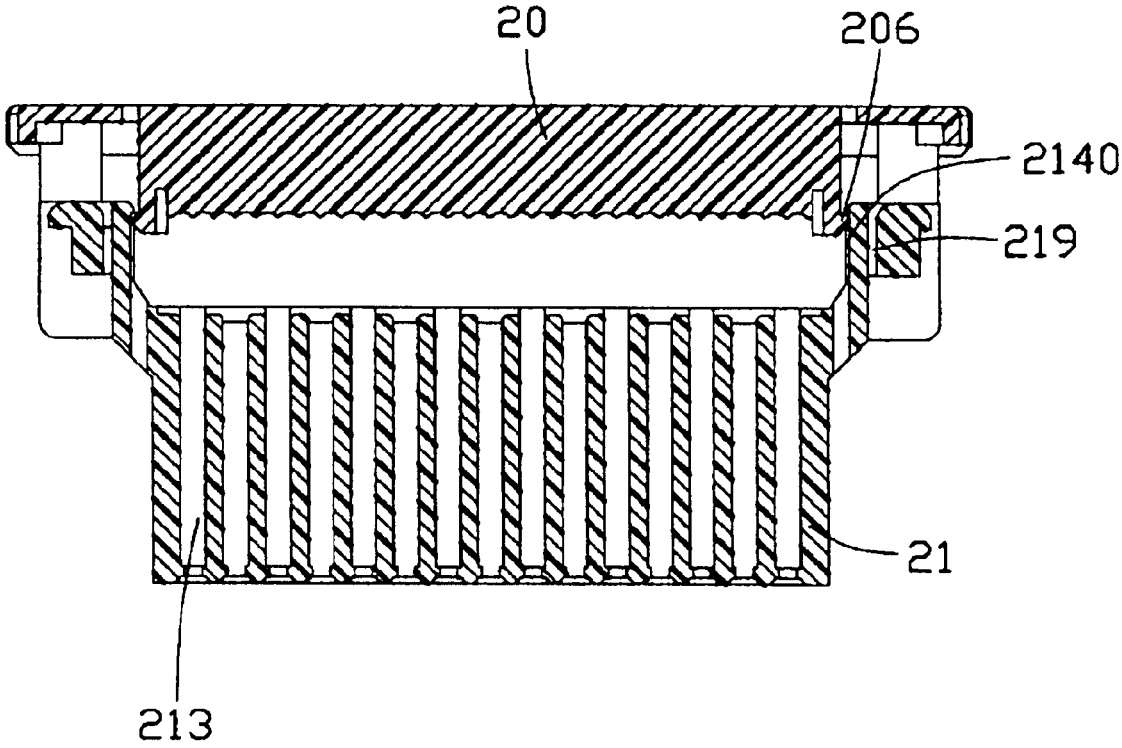
FIG. 3 is a cross-sectional view only showing that the top cover engaging with a bottom body of the IDC connector.

Referring to FIGS. 1–3, an IDC connector 2 is used to connect with a header connector 3 thereby forming an IDC connector assembly 1. The IDC connector 2 for terminating a flat cable 5 includes a top cover 20, a bottom body 21, a plurality of terminals 22 assembled to the bottom body 21 and a latch member 4 assembled to the bottom body 21. The flat cable 5 has conductors 52 side-by-side arranged in a jacket 53.

The top cover 20 is formed by plastics injection molding and has an elongated configuration. The top cover 20 includes a crossbeam 200, two pairs of opposite outer lockers 201 extending downwardly from opposite ends of the crossbeam 200. The crossbeam 200 has a scalloped bottom face 203 for fitting with the flat cable 5 and a pair of inner lockers 202 extending downwardly from opposite ends of the scalloped bottom face 204, Each of the outer lockers 201 is provided with a bottom hook 204 extending inwardly from a bottom end thereof. Similarly, each of the inner lockers 202 includes a bottom hook 206 extending outwardly from a bottom end thereof.

The bottom body 21 has a top terminating face 211, a bottom mating face 212 and two rows of slots 213 extending from the terminating face 211 to the mating face 212 for receiving corresponding terminals 22. The bottom body 21 has an elongated configuration with two lateral ends each being provided with a tower 214. The towers 214 each have two inner surfaces 215 above the terminating face 211 and facing to each other, which are spaced from each other a distance substantially equal to a width of the flat cable 5. Thus, the flat cable 5 can be guided by the inner faces 215 to be precisely terminated by the terminals 22. Each tower 214 has front and rear walls 216 which define a recess 217 therebetween, and a top wall 218 connecting with the front and rear walls 216. The top wall 218 defines a through hole 219 communicating with the recess 217. Either the front or the rear wall 216 has a laterally outwardly protruding projection 2160. In addition, the towers 214 each define a slit 2140 on the inner surface 215 for receiving a corresponding bottom hook 206 of the inner locker 202. In addition, two vertically extending ridges 210 are formed on a front wall of the bottom body 21 for providing a polarization function to the IDC connector 2 so that it can correctly mate with the header connector 3.

Each of the terminals 22 has a fork-shaped termination section 221 projecting upwardly beyond the terminating face 211. The termination section 221 is used for piercing through the jacket 53 of the flat cable 5 and clamping a corresponding conductor 52 whereby the terminals 22 and the flat cable 5 can be electrically connected together.

The latch member 4 is stamped and formed from spring metal such as stainless steel and includes a first latch arm 41 and a second latch arm 42, connected by a bight 40 to yield a generally U-shaped profile. The first latch arm 41 has a push bottom 411 and an bottom hook 412 extending opposite to the second latch arm 42 from a bottom end thereof. The second latch arm 42 has a boardlock-like shape and includes a pair of opposite peckers 421 which define a deform space therebetween for deformation of the peckers 421. Each of the peckers 421 forms a barb 422 extending outwardly from a bottom end thereof.

The header connector 3 is used for receiving and electrically connecting with the IDC connector 2. The header connector 3 has an insulative base 30 with a front wall 301, a rear wall 302 and a bottom wall 304 connecting with bottom ends of the front and rear walls 301, 302. Header pins 31 are fitted to the bottom wall 304 with solder tails 311 extending downwardly beyond the bottom wall 304. Two girders 305 are respectively provided at the lateral walls 303 of the insulative base 30. Each lateral wall 303 is provided with an opening 300 extending downwardly from a top edge thereof to a position below a corresponding girder 305. A rectangular hole 306 is defined in a middle of the front wall 301 for receiving the ridges 210 of the bottom body 21 when the IDC connector 2 mates with the header connector 3. A post 307 is integrally extended from the bottom wall 304 which is used for properly locating the header connector 3 on a PCB 6.

The PCB 6 defines two rows of plated through holes 62 and a non-plated through hole 64 beside the plate through holes 62. When the header connector 3 is mounted on the PCB 6, the solder tails 311 of the terminals 31 are fitted in the plated through holes 62, and the post 307 is fitted in the non-plated hole 64. Thereafter, the PCB 6 and the header connector 3 combination is subjected to a wave soldering process thereby soldering the solder tails 311 to the PCB 6.

Figure 4:
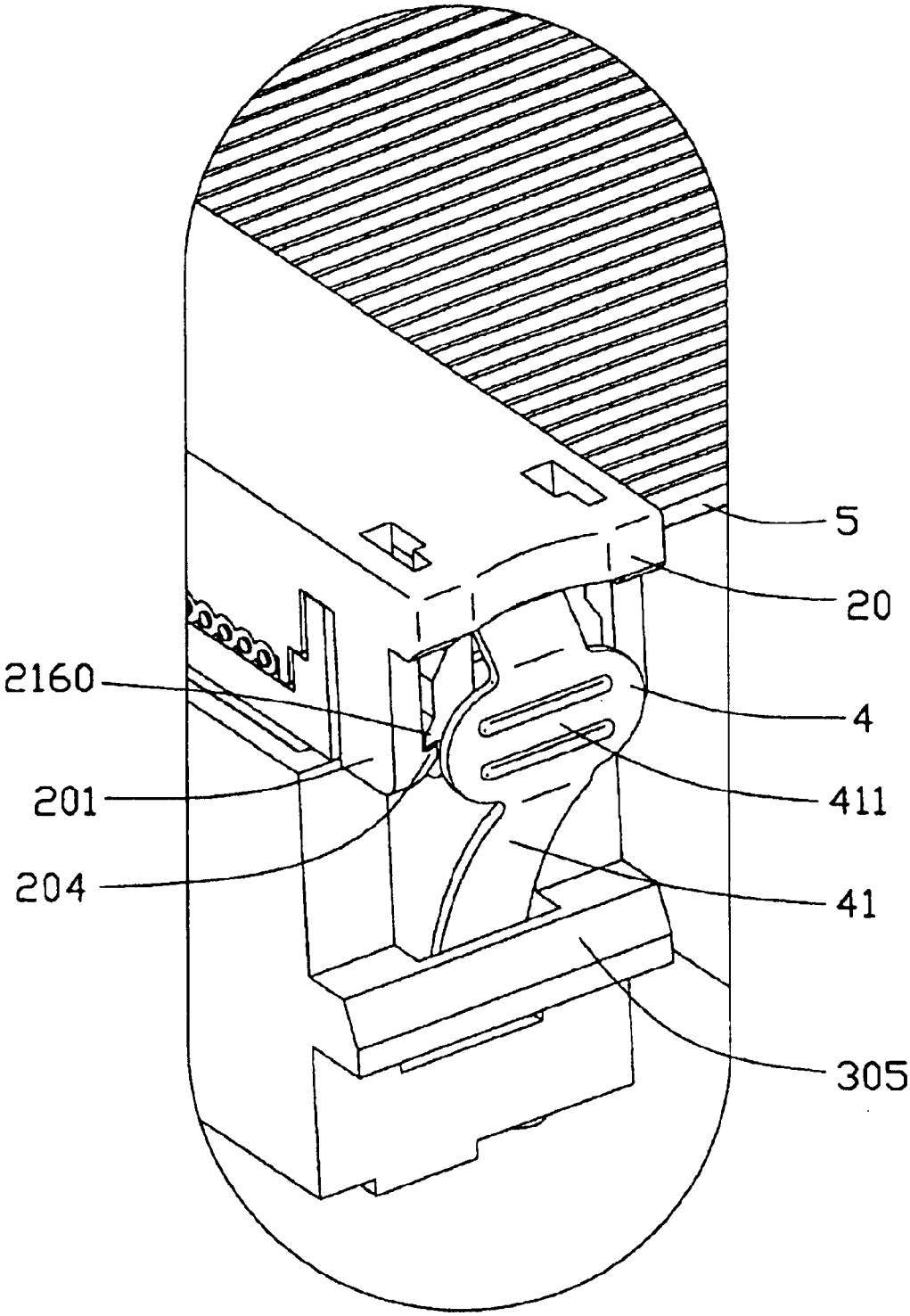
FIG. 4 is a partial, perspective assembled view of the IDC connector, the header connector and the flat cable.
Figure 5:
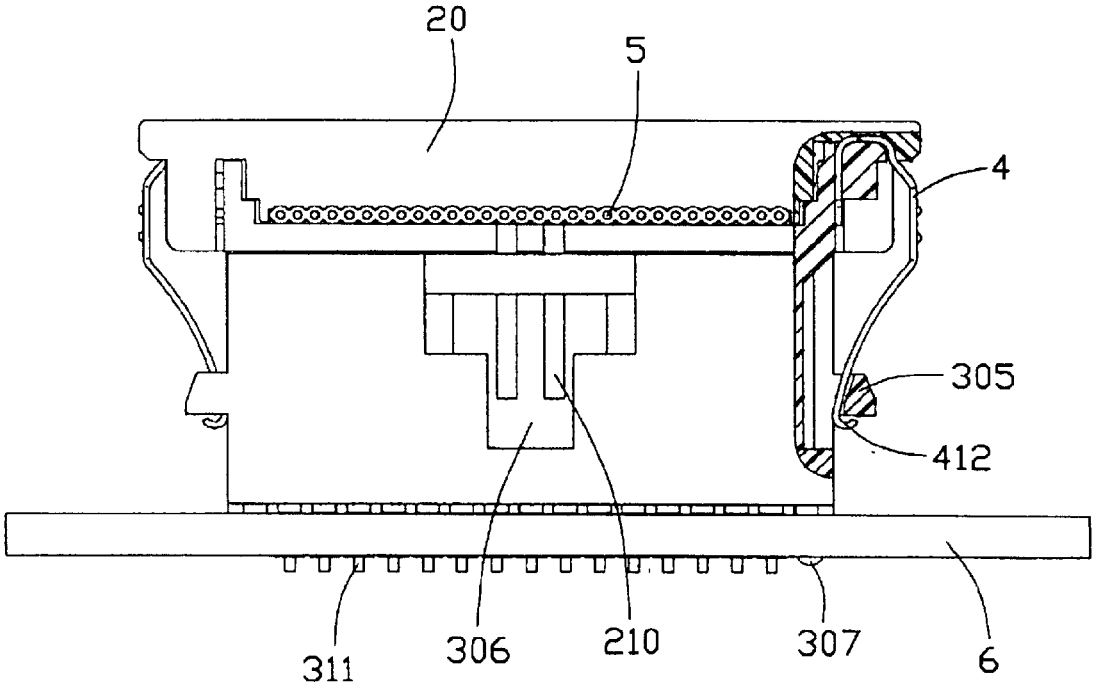
FIG. 5 is a partially cross-sectional view showing the flat cable, the IDC connector and the header connector mounted on the PCB.

In assembly, referring to FIGS. 4 and 5, at first, the latches 4 are assembled to the bottom body 21 with the peckers 421 of the second latch arms 42 being pressed inwardly and retained in the through holes 219. The barbs 422 of the peckers 421 engage with a bottom surface of the top wall 218 of the tower 214 for preventing the latch member 4 from moving upwardly. Successively, the scalloped bottom face 203 of the top cover 20 is spaced from the terminating face 211 of the bottom body 2 a distance and the flat cable 5 is movable on the terminating face 211. The top cover 20 is then pressed down and assembled to the bottom body 21. The scalloped bottom face 203 of the top cover 20 fittingly depresses the cable 5 against the terminating face 211 so that the termination sections 221 of the terminals 22 pierce through the jacket 53 of the cable 5 to clamp the conductors 52 of the cable 5, respectively, whereby the terminals 22 are electrically connected with the respective conductors 52. Furthermore, the bottom hooks 204 of the outer lockers 201 engage with corresponding projections 2160 of the towers 214, and the bottom hooks 206 of the inner lockers 202 engage with top faces above the sits 2140 of the towers 214, respectively to securely fasten the top cover 20 and the bottom body 21 together. In addition, a bottom surface of the top cover 20 presses against a top surface of the bight 40 of the latch member 4 and a bottom surface of the bight 40 abuts against with a top surface of the top wall 218 of the tower 214. Finally, the IDC connector 2 together with the flat cable 5 is assembled to the header connector 3 mounted on the PCB 6 by inserting the bottom body 21 into a space of the header connector 60 defined between the front, rear, lateral walls and bottom walls 301, 302, 303, 304 thereof to reach a position in which the ridges 210 are received in the rectangular hole 306. The first latch arms 41 are pressed inwardly and moved downwardly along the opening 300. Then, the first latch arms 41 deform outwardly and the bottom hooks 412 engage with corresponding girders 305 thereby securely retaining the IDC connector 2 to the header connector 3. The mating face 212 abuts against the bottom wall 304, and the header pins 31 electrically engage with the terminals 22, respectively.

Figure 6:
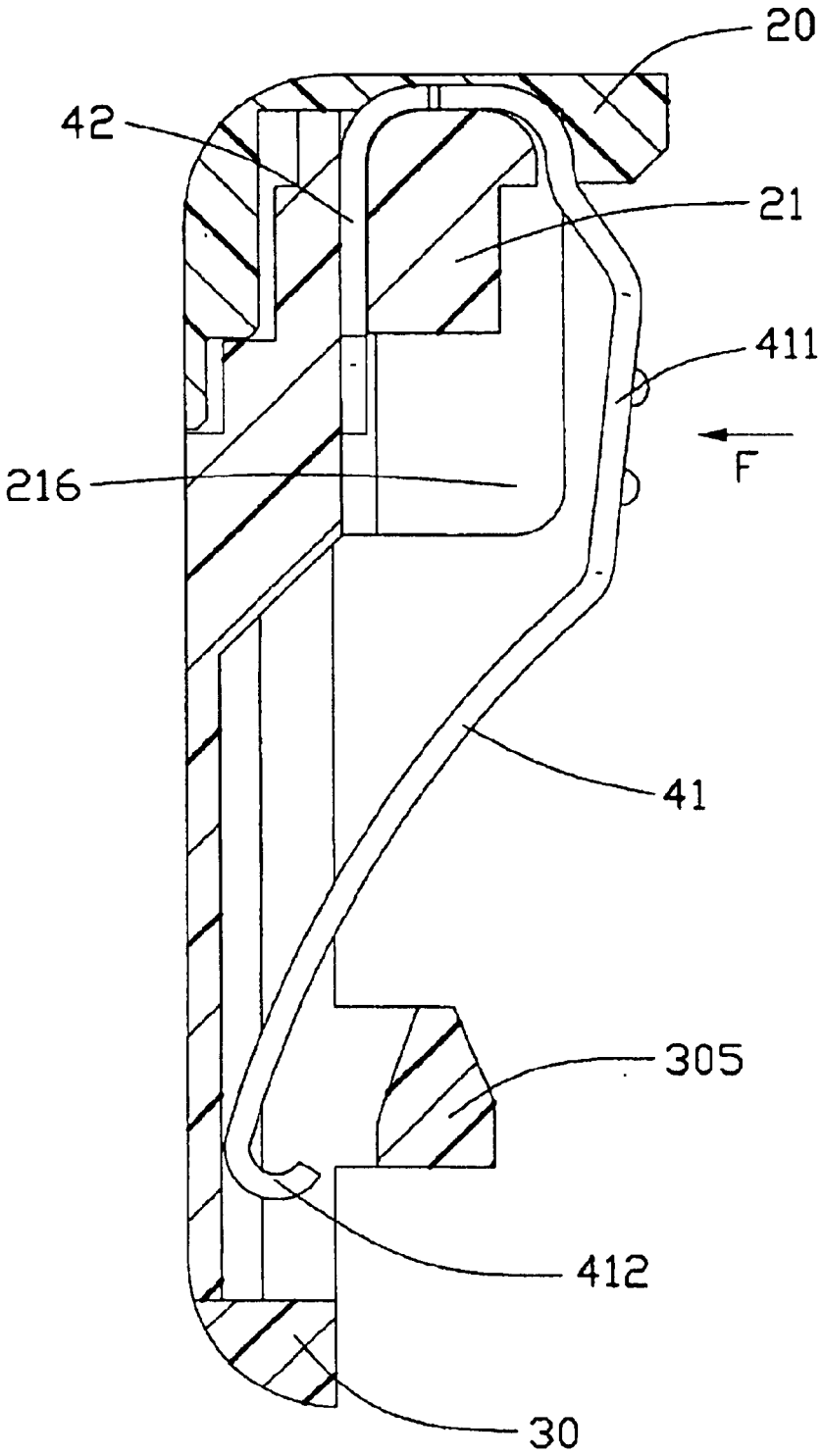
FIG. 6 is partially cross-section view showing a disengagement between a hook and a girder.

Referring to FIG. 6, to separate the IDC connector 2 from the header connector 3, the first latch arms 41 are deflected inwardly to the openings 300 by exerting a push force F on each of the push buttons 411 so that the bottom hooks 412 disengage from the girders 305. Then, the IDC connector 2 can be separated from the header connector 3 by exerting an upwardly pulling force to the IDC connector 2. In the present invention, an overstress of the latch member 4 due to the push force F can be prevented by an engagement between the lateral walls of the bottom body 21 and the first latch arms 41. In addition, the engagement between the push buttons 411 of the first latch arms 41 and the front, rear walls 216 of the towers 214 also can prevent the bottom hook 412 from overstress due to the push force F.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for electrically connecting a flat cable to a complementary header connector, the electrical connector comprising:

a top cover including a crossbeam, two pairs of opposite outer lockers each with a first bottom hook that extending downwardly from opposite ends of the crossbeam, wherein the crossbeam having a scalloped bottom face for fitting with the flat cable and a pair of inner lookers each with a second bottom hook that extending downwardly from opposite ends of the scalloped bottom face;

a bottom body having an elongated configuration with two lateral ends each being provided with a tower, a plurality of terminals assembled to the bottom body and adapted for electrically connecting with the flat cable, wherein the tower having front and rear walls which define a recess therebetween, a top wall defines a through hole communicating with the recess, either the front or the rear wall having a laterally outwardly protruding projection for engaging with the first bottom hook, a slit on an inner surface of the tower for receiving the second bottom hook to securely fasten the top cover and the bottom body together; and a latch member being adapted for connecting the electrical connector to the header connector, wherein the latch member including a first latch arm, a second latch arm and a bight therebetween the first latch arm including a push bottom and a third bottom hook, the second latch arm having a boardlock-like shape and a pair of opposite peckers, each of the peckers forming a barb that extending outwardly from a bottom end thereof to be received in the through hole of the tower.

2. The electrical connector as described in claim 1, wherein the bight being sandwiched between the top cover and the tower.

3. The electrical connector as described in claim 1, wherein the latch member is stamped and formed from a metallic sheet.

* * * * *